US010042327B2

(12) United States Patent
Sawada et al.

(10) Patent No.: US 10,042,327 B2
(45) Date of Patent: Aug. 7, 2018

(54) TIMEPIECE

(71) Applicant: Seiko Epson Corporation, Tokyo (JP)

(72) Inventors: Akihiro Sawada, Matsumoto (JP); Shuichi Tamura, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/208,881

(22) Filed: Jul. 13, 2016

(65) Prior Publication Data

US 2017/0023915 A1 Jan. 26, 2017

(30) Foreign Application Priority Data

Jul. 22, 2015 (JP) ..... 2015-144949

(51) Int. Cl.
*G04C 10/02* (2006.01)
*G04G 17/06* (2006.01)

(52) U.S. Cl.
CPC ..... *G04C 10/02* (2013.01); *G04G 17/06* (2013.01)

(58) Field of Classification Search
CPC ..... G04C 10/02; G04G 17/06
See application file for complete search history.

(56) References Cited

U.S. PATENT DOCUMENTS 3,427,797 A * 2/1969 Negoro ..... G04C 10/02 136/249
3,786,624 A * 1/1974 Uchiyama ..... G04C 10/02 136/244
3,890,776 A * 6/1975 Urushida ..... G04C 3/008 136/244
4,261,049 A * 4/1981 Komiyama ..... G04C 10/02 368/205
4,296,489 A * 10/1981 Mitsui ..... G04C 3/004 323/273
6,521,822 B2 * 2/2003 Ito ..... G04C 10/02 136/244
6,791,905 B1 * 9/2004 Sekiguchi ..... G04B 19/12 368/205
7,746,731 B2 * 6/2010 Murakami ..... G04C 10/02 136/244
9,530,915 B2 * 12/2016 Saito ..... G04C 10/02
2012/0105288 A1 * 5/2012 Abe ..... G04C 10/02 343/702

(Continued)

FOREIGN PATENT DOCUMENTS

JP 10-239453 A 9/1998
JP 2000-292569 A 10/2000

(Continued)

*Primary Examiner* — Edwin A. Leon
*Assistant Examiner* — Jason Collins
(74) *Attorney, Agent, or Firm* — Harness, Dickey & Pierce, P.L.C.

(57) ABSTRACT

A timepiece has a solar panel including a plurality of solar cells; a dial disposed on the face side of the solar panel and configured to transmit a light; a molding member disposed to the face side of the dial overlapping the outside edge of the dial when seen from the face side of the timepiece; and an opaque light shield disposed on the face side of the dial on the inside side of the molding member; the solar panel having connectors that connect adjacent solar cells in series, and at least part of each connector is covered by the light shield when seen from the face.

9 Claims, 5 Drawing Sheets

(56) References Cited

U.S. PATENT DOCUMENTS

| | | | | |
|---|---|---|---|---|
| 2013/0258822 | A1* | 10/2013 | Takenawa | H01L 31/042 368/205 |
| 2014/0060614 | A1* | 3/2014 | Saito | H01L 31/0465 136/244 |
| 2014/0241131 | A1 | 8/2014 | Honda | |
| 2015/0268639 | A1* | 9/2015 | Abe | G04R 60/00 368/47 |

FOREIGN PATENT DOCUMENTS

| | | | |
|---|---|---|---|
| JP | 2002-006065 | A | 1/2002 |
| JP | 2014-002067 | A | 1/2014 |
| JP | 2014-173921 | A | 9/2014 |

* cited by examiner

TIMEPIECE

BACKGROUND

1. Technical Field

The present invention relates to a timepiece with a solar panel.

2. Related Art

Timepieces that have a solar panel and are driven by the power produced by the solar panel are known from the literature. See, for example, JP-A-2014-173921.

The timepiece taught in JP-A-2014-173921 has a solar panel of which the power generating unit is divided into seven solar cells. The outside circumference of the solar panel matches the inside circumference of the dial ring, and the outside edge of the solar panel is hidden by the dial ring.

The timepiece taught in JP-A-2014-173921 generally has connectors on the outside circumference of the individual solar panels (solar cells) for connecting adjacent solar panels (solar cells) in series, and the dial ring is shaped to hide these connectors.

Current consumption in timepieces powered by a solar panel has gradually increased with the addition of more functions, and improving the generating capacity of the solar panel is desirable.

SUMMARY

A timepiece according to the invention improves the generating capacity of the solar panel.

A timepiece according to an aspect includes: a solar panel including a plurality of solar cells; a dial disposed on the face side of the solar panel and configured to transmit a light; a molding member disposed to the face side of the dial overlapping the outside edge of the dial when seen from the face side of the timepiece; and an opaque light shield disposed on the face side of the dial on the inside side of the molding member; the solar panel having connectors that connect adjacent solar cells in series, and at least part of each connector is covered by the light shield when seen from the face.

The molding member may be a dial ring, for example. The light shield is embodied by index markers and subdials, for example, disposed on the face side of the dial.

Because the inside circumference edge of the molding member is on the outside side of the connectors when seen from the face side of the timepiece, the inside edge can be located on the outside side more easily than if the molding member overlaps the connector. As a result, the area inside the molding member can be increased, the area of the power generating unit of the solar panel can be increased accordingly, and power generation by the solar panel can be improved. For example, because the areas between adjacent connectors at the outside perimeter of the solar panel can be used as part of the power generating unit if the plural connectors are disposed along the outside perimeter of the solar panel, the area of the power generating unit can be increased accordingly.

Furthermore, because the areas of the solar cells that overlap the light shield are not exposed to light, they are non-generating portions that do not produce power. Furthermore, the connectors have a wiring layer and are therefore non-generating areas. Because at least part of the connectors is superimposed with the light shield, the total area of the non-generating parts can be made smaller than if the connectors are not superimposed with the light shield. In other words, the effective generating area, which is the area that is useful for generating power, can be increased and power generation can be improved.

Further preferably in a timepiece according to another aspect, the generating area that receives light through the dial is the same in each of the solar cells.

Because the solar cells are connected in series, the current of the solar panel is limited to the current of the solar cell with the smallest current flow. Therefore, to maximize the power output of the solar panel, the current of the solar cells is preferably as uniform as possible. More specifically, the generating area, which is the area not including the shielded areas that is effective for producing power, is preferably equal in each of the solar cells.

Because the generating area of each solar cell is the same, the generating capacity of the solar panel can be maximized.

Note that the generating area of the solar cells is the same includes being substantially the same, and means that the generating area of the solar cells is within +/−10% of the average generating area of all solar cells.

In a timepiece according to another aspect, a divider lead separating one solar cell from the adjacent solar cell has a bend, and the bend is covered by the light shield when seen from the face.

Because a divider lead in this embodiment has a bend, the divider leads can be drawn more freely than if the divider lead is configured as a single straight line, and the shape and area of each solar cell can be determined more freely.

Furthermore, bends in the divider leads are more conspicuous to the user than straight lines, but because the bends are superimposed with a light shield, they are not visible to the user. The appearance can therefore be improved.

Further preferably in an electronic timepiece according to another aspect, the solar panel includes five or more solar cells.

In this embodiment, the solar panel comprises five solar cells. The EMF of one solar cell is approximately 0.6-0.7 V. As a result, if five solar cells are connected in series, creating a five cell solar panel, an EMF of approximately 0.6-0.7 V×5 cells=approximately 3-3.5 V is produced, which is sufficient to completely charge a 2.4 V lithium ion battery, for example.

Likewise, if seven or eight solar cells are connected in series, the EMF is approximately 0.6-0.7 V×7 or 8 cells=approximately 4.2-4.9 V or 4.8 to 5.6 V, and a 3.7 V lithium ion battery can be completely charged.

Because a lithium ion battery with a high EMF of 2.4 V or 3.7 V can thus be used as the power supply, a high current consumption device such as a GPS receiver can be incorporated and driven.

An electronic timepiece according to another aspect also has an hour hand; and the light shield is a marker representing the hour when pointed to by the hour hand.

If the markers are index markers denoting the hours so that 1:00 to 12:00 can be indicated, there are twelve markers around the outside edge of the dial when seen from the face.

Because the connectors are generally disposed along the outside edge of the solar panel, if there are twelve or fewer connectors, all connectors can be covered by a marker.

As a result, the area of overlap between connectors and light shields is greater than in a configuration in which superimposing all connectors with a light shielding member is difficult, such as a configuration in which the connectors are superimposed with light shielding members such as curved indicators disposed to selected areas along the outside of the dial. The effective generating area is therefore greater and power generation can be improved.

An electronic timepiece according to another aspect preferably also has: twelve markers disposed at equal intervals along the inside circumference of the molding member as light shields; a first subdial disposed near 2:00, a second subdial disposed near 10:00, and a third subdial disposed near 6:00 around the plane center of the dial when seen from the face; and an aperture formed in the solar panel at a position corresponding to 4:00 on the dial. The solar panel includes eight solar cells; the connectors are disposed at positions corresponding to 12:00, 1:00, 3:00, 5:00, 6:00, 8:00, and 11:00 on the dial; and at least part of each connector is covered by a marker when seen from the face.

The light shield in a timepiece according to another aspect includes the twelve markers disposed at an equal interval along the inside circumference of the molding member, a first subdial disposed near 2:00, a second subdial disposed near 10:00, and a third subdial disposed near 6:00 around the plane center of the dial when seen from the face. The solar panel includes eight solar cells, and an aperture is formed in the solar panel at a position corresponding to 4:00 on the dial.

By disposing the connectors are disposed at positions corresponding to 12:00, 1:00, 3:00, 5:00, 6:00, 8:00, and 11:00 on the dial, each connector can be superimposed with a marker, and the shape of each solar cell can be set so that the generating area of each solar cell is the same.

Other objects and attainments together with a fuller understanding of the invention will become apparent and appreciated by referring to the following description and claims taken in conjunction with the accompanying drawings.

DESCRIPTION OF EMBODIMENTS

Basic Configuration of the Timepiece 1

Figure 1:
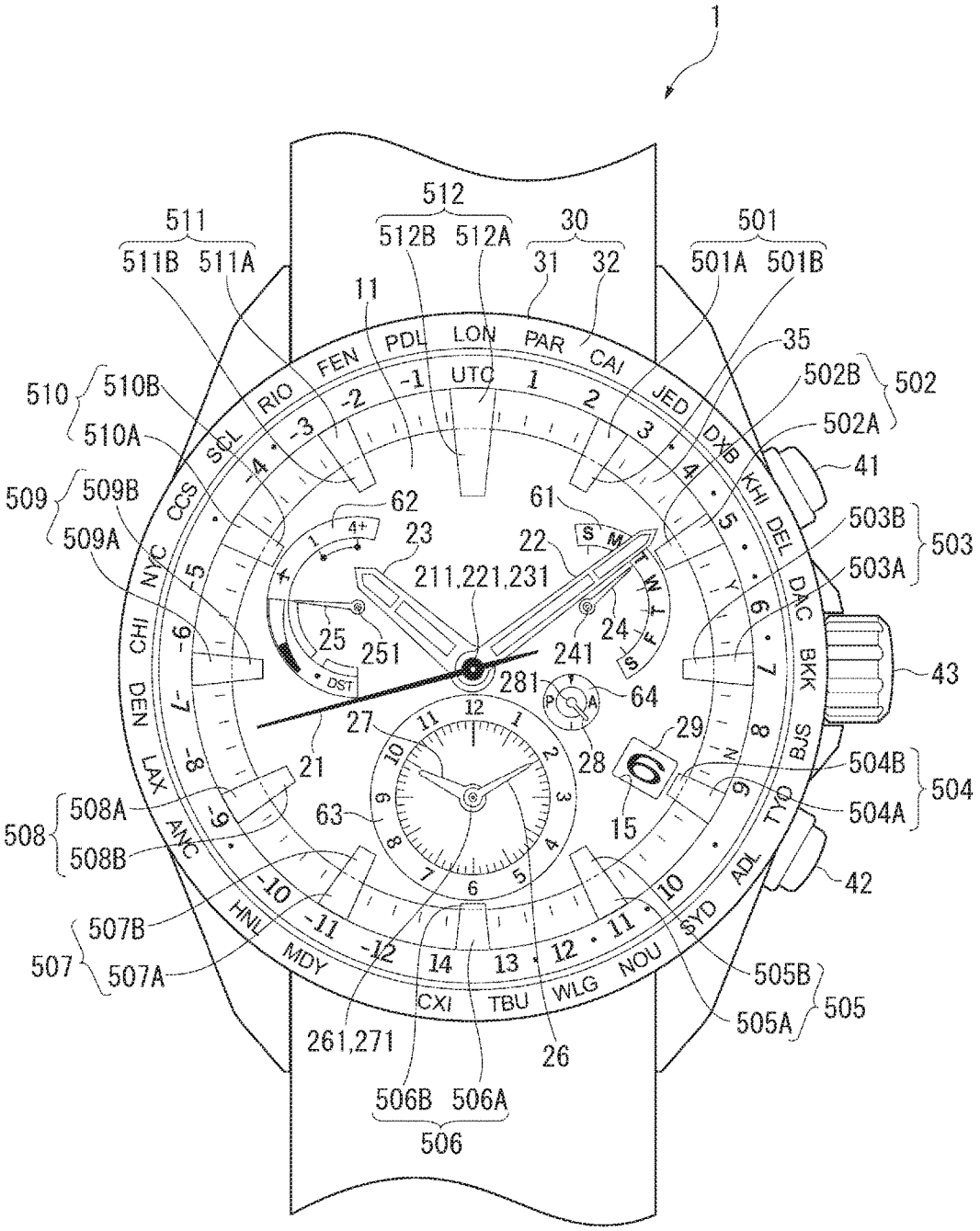
FIG. 1 is a plan view showing the face of a timepiece.
Figure 2:
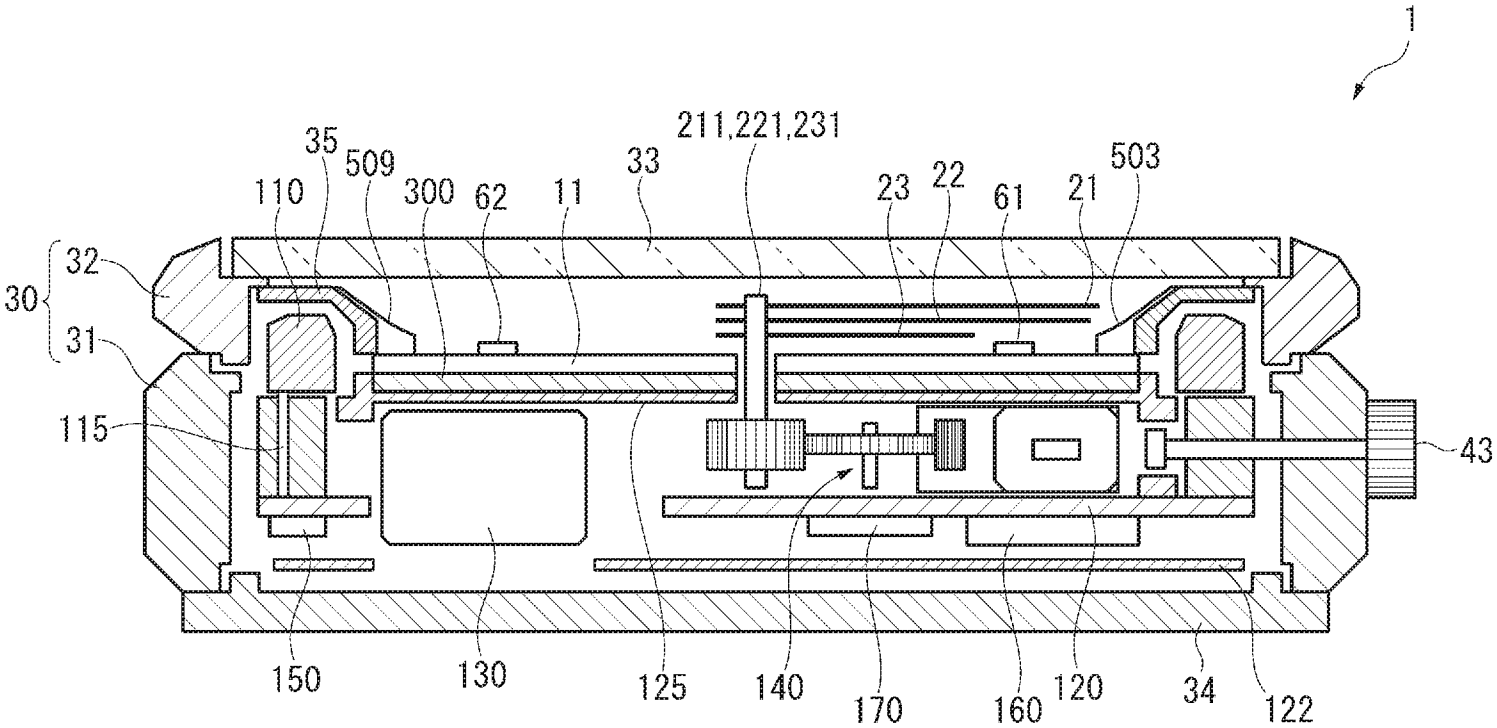
FIG. 2 is a section view of the timepiece according to this embodiment.

FIG. 1 is a plan view showing the face of the timepiece 1, and FIG. 2 is a section view showing the basic configuration of the timepiece 1.

As shown in FIG. 1 and FIG. 2, the electronic timepiece 1 has an external case 30, crystal 33, and back cover 34. The external case 30 includes a ceramic bezel 32 affixed to a cylindrical metal case member 31. A round dial 11 is held inside the inside circumference of the bezel 32 by means of a plastic, ring-shaped dial ring 35.

Disposed in the side of the external case 30 are a button A 41, a button B 42, and a crown 43.

Of the two main openings in the case member 31, the opening on the face side of the timepiece 1 is covered by the crystal 33 held by the bezel 32, and the opening on the back side is covered by the metal back cover 34.

Inside the external case 30 are the dial ring 35 attached to the inside circumference of the bezel 32, hands 21 to 28, a date indicator 29, and a drive mechanism 140 that drives the hands and the date indicator 29.

The dial ring 35 is ring-shaped in plan view, and conically shaped in section view. In plan view, the dial ring 35 overlaps the outside edge of the face side of the dial 11, and determines the apparent diameter of the dial 11. A donut-shaped space is created by the dial ring 35 and the inside circumference surface of the bezel 32, a ring-shaped antenna 110 is housed in this space.

The dial ring 35 is an example of a molding member in this embodiment.

The dial 11 is a disk shaped member for displaying the time inside the external case 30, is made of polycarbonate or other optically transparent material, transmits a light, and is disposed inside the dial ring 35 with the hands between the crystal 33 and the dial 11.

A solar panel 300 for converting light to electrical power is disposed between the dial 11 and the main plate 125 to which the drive mechanism 140 is disposed. The configuration of the solar panel 300 is described in detail below.

Through-holes through which the pivots 211, 221, 231, 241, 251, 261, 271, 281 of the hands 21 to 28 pass are formed in the dial 11, solar panel 300, and main plate 125. An aperture for the date window 15 is also formed in the dial 11 and solar panel 300.

The drive mechanism 140 is disposed to the main plate 125, and is covered by the circuit board 120 on the back cover side. The drive mechanism 140 includes a stepper motor and wheel train, and drives the hands by the stepper motor rotationally driving the pivots through the wheel train.

The drive mechanism 140 more specifically includes first to sixth drive mechanisms. The first drive mechanism includes drives the minute hand 22 and hour hand 23; the second drive mechanism drives the second hand 21; the third drive mechanism drives hand 24; the fourth drive mechanism drives hand 25; the fifth drive mechanism drives hands 26, 27, and 28; and the sixth drive mechanism drives the date indicator 29.

The circuit board 120 is populated with a GPS receiver 150, a controller 160, and a storage device 170. The circuit board 120 and antenna 110 are connected with an antenna connection pin 115. The GPS receiver 150, controller 160 and storage device 170 are disposed to the back cover 34 side of the circuit board 120, and are isolated from the back cover 34 by a circuit cover 122. A lithium ion or other type of storage battery 130 is disposed between the main plate 125 and the back cover 34. The storage battery 130 is charged by power produced by the solar panel 300.

Display Mechanism of the Timepiece 1

Indexes 501 to 512 (bar indexes) are disposed as bar-shaped decorative members on the dial ring 35 surrounding the dial 11. The indexes 501 to 512 are made from metal or other light-blocking material.

The indexes 501 to 512 are disposed at equal intervals corresponding to markers for 1:00 to 12:00 on the dial 11.

The index 501 at 1:00 has a base portion 501A that overlaps the dial ring 35 in plan view, and an extended portion 501B that extends toward the plane center of the dial 11 from the edge of the base portion 501A on the side closer to the plane center of the dial 11. The extended portion 501B therefore overlaps the dial 11 in plan view.

The other indexes 502 to 512 are configured similarly to index 501, and have a base portion 502A-512A and an extended portion 502B-512B.

The dial ring 35 also has markers dividing the spaces between adjacent indexes 501 to 512 into five equal intervals.

The hands 21, 22, 23 are disposed to pivots 211, 221, 231 passing through the front and back of the dial 11 in the plane center of the dial 11.

By pointing to the indexes 501 to 512 and minute markers disposed to the dial ring 35, hand 21 (second hand) indicates the second of the first time (the local time, such as the current local time when travelling abroad), hand 22 (minute hand) indicates the minute of the first time, and hand 23 (hour hand) indicates the hour of the first time. Note that because the second of the first time and the second of the second time are the same, the user can know the second of the second time by reading the second hand 21.

Hand 24 is disposed to a pivot 241 offset from the center of the dial 11 near 2:00.

A decorative subdial 61 shaped in an arc centered on the pivot 241 is formed on the surface of the dial 11 facing the crystal 33 (the face side). This subdial 61 is also made of metal or other light-blocking material.

The letters S, M, T, W, T, F, S denoting the seven days of the week are disposed on the surface of the subdial 61. The hand 24 points to one of the letters S, M, T, W, T, F, S to indicate the day of the week.

Hand 25 is attached to a pivot 251 disposed to a small dial offset from the center of the dial 11 near 10:00.

Another subdial 62 shaped in an arc centered on the pivot 251 is formed on the surface of the dial 11. This subdial 62 is also made of metal or other light-blocking material.

Letters or symbols denoting the daylight saving time setting (DST meaning the daylight saving time mode is on, and the black dot meaning the DST mode is off), the reserve capacity of the storage battery 130, the airplane mode, and satellite signal reception mode are disposed to the subdial 62. The hand 25 points to the approximately marker to display specific information.

Hands 26 and 27 are disposed to pivots 261, 271 disposed to the same position near 6:00 from the plane center of the dial 11.

An annular subdial 63 centered on the pivot 261 in plan view is also disposed on the surface of the dial 11. The subdial 63 is made from metal or other light-blocking member.

The numerals 1 to 12 denoting the hour are formed around the inside edge on the surface of the subdial 63. Sixty minute markers are also disposed around the inside edge of the subdial 63 on the surface of the dial 11.

By pointing to these numerals and markers, the hand 26 indicates the minute of the second time (home time, such as Japan time while travelling in a country outside Japan), and the other hand 27 indicates the hour of the second time.

Hand 28 is attached to a pivot 281 disposed offset toward 4:00 from the plane center of the dial 11.

An annular subdial 64 centered on the pivot 281 in plan view is also disposed to the surface of the dial 11. The subdial 64 is made from metal or other light-blocking member.

The letter A denoting ante meridian, and the letter P denoting post meridian, are formed on the surface of the subdial 64. By pointing to A or P, the hand 28 indicates whether the time of the second time is ante meridian or post meridian.

The date window 15 is disposed near 4:00 offset from the plane center of the dial 11. The date window 15 is a small rectangular opening in the dial 11 and solar panel 300 through which the date (number) printed on the date indicator 29 can be seen. The date indicator 20 displays the day value of the current date at the first time with the number that is visible through the date window 15.

The extended portions 501B-512B and subdials 61 to 64 block light that is incident from the crystal 33 side. As a result, light passing through the dial 11 is not incident to the solar panel 300 in the areas covered in plan view by the extended portions 501B-512B and subdials 61 to 64. In other words, the extended portions 501B-512B and subdials 61 to 64 are examples of opaque light shields. The extended portions 501B-512B are examples of markers, subdial 61 is an example of a first subdial, subdial 62 is an example of a second subdial, and subdial 63 is an example of a third subdial.

Configuration of the Solar Panel 300

Figure 3:
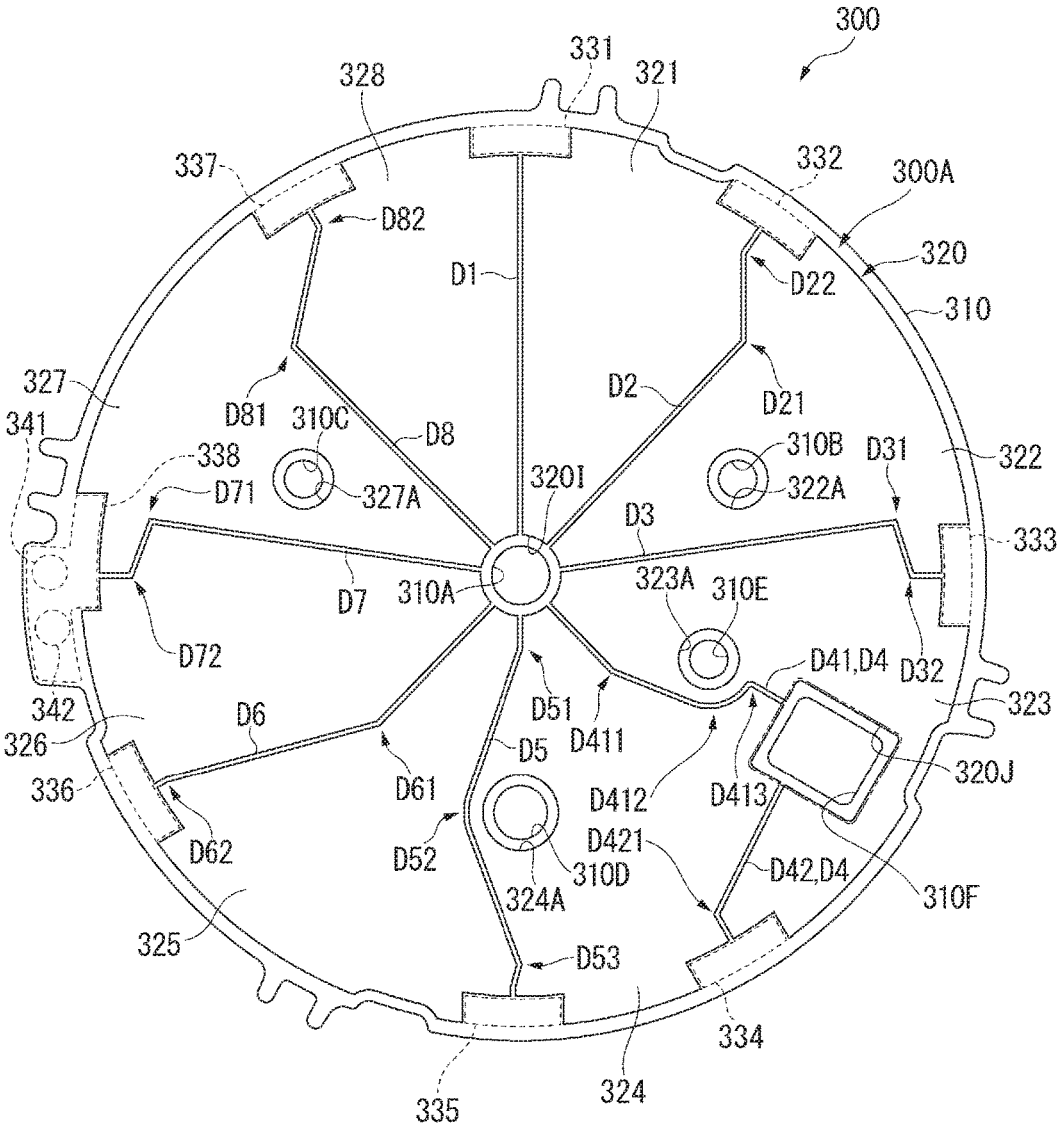
FIG. 3 is a plan view of the solar panel in this embodiment.
Figure 4:
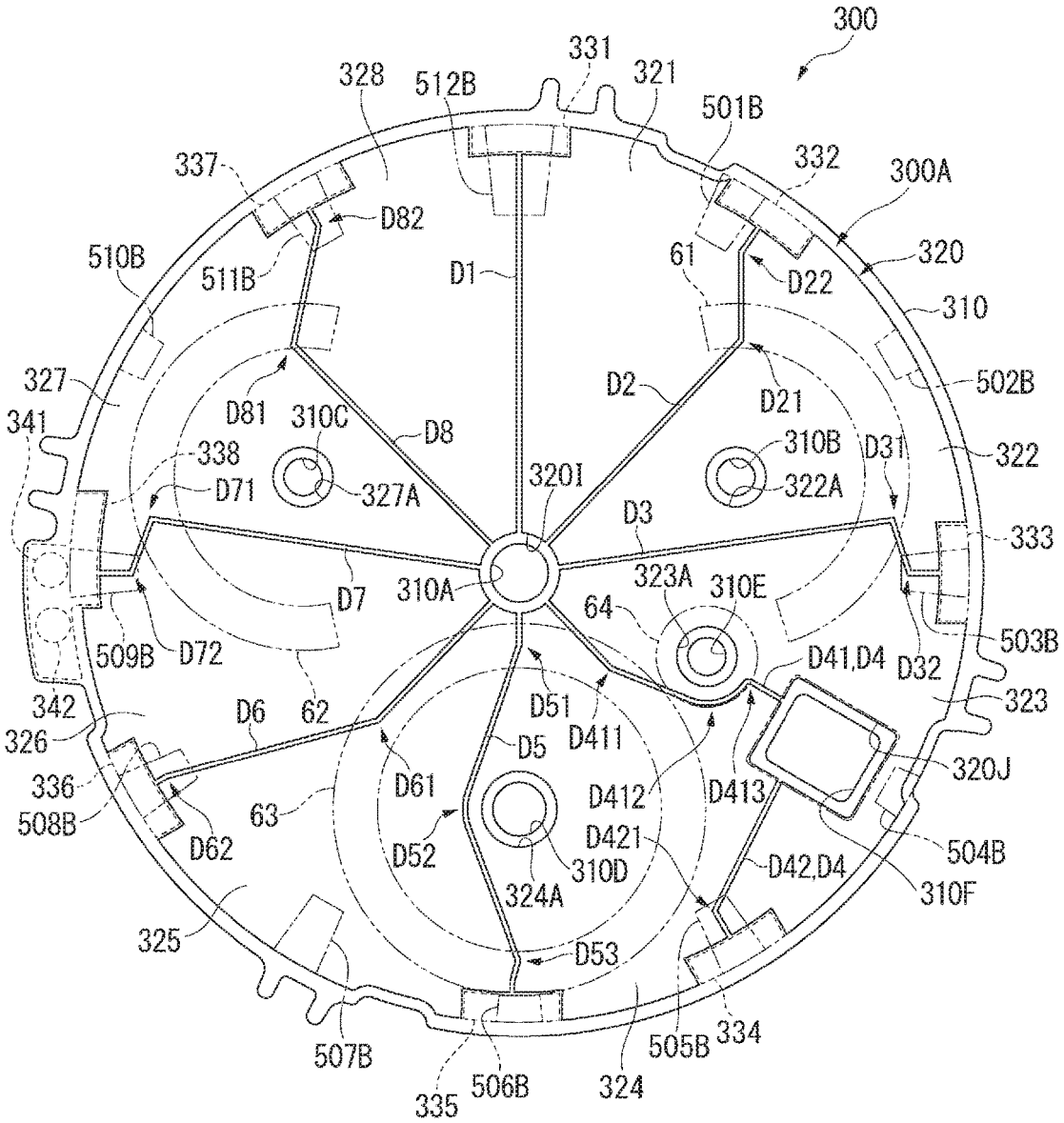
FIG. 4 shows light shields projected onto the solar panel in this embodiment.

FIG. 3 is a plan view of the solar panel 300. FIG. 4 illustrates the extended portions 501B-512B and subdials 61 to 64 disposed on the surface of the dial 11 projected onto the solar panel 300. In FIG. 4, the double-dot dash lines indicate these projections, and the dotted lines indicate parts that are hidden and do not appear on the surface side (electrodes 341, 342) and parts shown conceptually (connectors 331-337, electrode lead 338).

The solar panel 300 is a photovoltaic device that converts light energy to electrical energy. As shown in FIG. 3 and FIG. 4, the solar panel 300 includes a disk-shaped substrate 310, electrodes 341, 342 disposed on the back side of the substrate 310, and solar panel body 300A that is round in plan view and disposed on the face side of the substrate 310. The electrodes 341, 342 are the positive and negative electrodes of the solar panel 300, and are connected to terminals of the circuit board 120 through a spring member or other conductive member.

Substrate 310 Configuration

The substrate 310 is a dielectric member such as a plastic film.

The outside circumference of the substrate 310 is slightly greater than the inside circumference of the dial ring 35, and the outside circumference of the substrate 310 overlaps the dial ring 35 in plan view.

Formed in the substrate 310 are a through-hole 310A through which pivots 211, 221, 231 pass; through-hole 310E through which pivot 241 passes; through-hole 310C through which pivot 251 passes; through-hole 310D through which pivots 261, 271 pass; through-hole 310E through which pivot 281 passes; and an aperture 310F corresponding to the date window 15.

Configuration of the Solar Panel Body 300A

The outside circumference of the solar panel body 300A is substantially the same as the inside circumference of the dial ring 35, and the outside edge of the solar panel body 300A is substantially coincident to the inside edge of the dial ring 35 in plan view.

The solar panel body 300A comprises multiple connectors 331 to 337 and an electrode lead 338 formed along the outside circumference, and a power generating unit 320 occupying the rest.

The power generating unit 320 comprises eight solar cells 321 to 328. The solar cells 321 to 328 are a multilayer configuration including a bottom electrode layer, semiconductor layer, insulation layer, top electrode layer, and a transparent sealant layer built up from the surface of the substrate 310. The solar cells 321 to 328 in this embodiment are amorphous silicon solar cells.

The connectors 331 to 337 connect adjacent solar cells in series. The electrode lead 338 electrically connects solar cells 326, 327 and electrodes 341, 342.

Connector 331 is at 12:00 on the dial 11, connector 332 is at approximately 1:00, connector 333 is at 3:00, connector 334 is at 5:00, connector 335 is at 6:00, connector 336 is at 8:00, the electrode lead 338 is at approximately 9:00, and connector 337 is at 11:00.

In plan view, the connectors 331 to 337 are located inside the dial ring 35, while part of the electrode lead 338 is inside the dial ring 35 and the other part overlaps the dial ring 35.

The specific configurations of the connectors 331-337 and electrode lead 338 are described further below.

Configuration of the Power Generating Unit 320

A through-hole 320I through which pivots 211, 221, 231 pass is formed in the center of the power generating unit 320. An aperture 320J corresponding to the date window 15 is also formed in the power generating unit 320.

The power generating unit 320 is divided into eight solar cells 321 to 328 by eight divider leads D1 to D8 extending in a radiating pattern from the through-hole 320I to the connectors 331 to 337 and electrode lead 338 on the outside.

Solar cell 321 is separated from adjacent solar cells 328 and 322 by the divider lead D1 from the through-hole 320I to connector 331, and the divider lead D2 from the through-hole 320I to connector 332. Divider lead D1 is straight; divider lead D2 has three straight parts and two bends D21, D22.

The connector 331 end of the divider lead D1 is superimposed with extended portion 512B.

Bend D21 of the divider lead D2 is superimposed with the subdial 61 in plan view.

Solar cell 322 is separated from adjacent solar cells 321, 323 by the above divider lead D2 and the divider lead D3 from the through-hole 320I to connector 333. Divider lead D3 has three straight parts and two bends D31, D32.

In plan view, bend D31 of divider lead D3 is superimposed with the subdial 61, and bend D32 and the connector 333 end of the divider lead D3 are superimposed with the extended portion 503B.

A through-hole 322A in which the pivot 241 is inserted is formed in the solar cell 322.

The solar cell 323 is separated by divider lead D3 and divider lead D4 from the adjacent solar cells 322, 324. Divider lead D4 includes a lead portion D41 from the through-hole 320I to the aperture 320J, and a lead portion D42 from the aperture 320J to the connector 334. Lead portion D41 has three straight parts and two bends D411, D413, and a curved portion D412 that goes in an arc around the outside of the subdial 64. Lead portion D42 has two straight parts and one bend D421. In plan view, bend D411 of lead portion D41 is superimposed with the subdial 63, and curved portion D412 and bend D413 are superimposed with the subdial 64, and bend D421 of lead portion D42 and the connector 334 end of lead portion D42 is superimposed with the extended portion 505B.

A through-hole 323A through which pivot 281 is inserted is formed in the solar cell 323.

Solar cell 324 is separated by the divider lead D4 and divider lead D5 going from the through-hole 320I to the connector 335 from the adjacent solar cells 323, 325.

A through-hole 324A in which pivots 261, 271 are inserted is formed in the solar cell 324.

Divider lead D5 has four straight segments two bends D51, D53, and a curved portion D52 that goes in an arc around the outside of through-hole 324A.

Bends D51, D53 of divider lead D5 are superimposed with the subdial 63 in plan view.

Solar cell 325 is separated by the divider lead D5 and divider lead D6 going from the through-hole 320I to the connector 336 from the adjacent solar cells 324, 326. Divider lead D6 has three straight segments and two bends D61, D62.

In plan view, bend D61 of divider lead D6 is superimposed with the subdial 63, and bend D62 and the connector 336 end of the divider lead D6 are superimposed with the extended portion 508B.

Solar cell 326 is separated by the divider lead D6 and divider lead D7 going from the through-hole 320I to the electrode lead 338 from the adjacent solar cells 325, 327. Divider lead D7 has three straight segments and two bends D71, D72.

In plan view, bend D71 of divider lead D7 is superimposed with the subdial 62, and bend D72 and the electrode lead 338 end of the divider lead D7 are superimposed with the extended portion 509B.

Solar cell 327 is separated by the divider lead D7 and divider lead D8 going from the through-hole 320I to connector 337 from the adjacent solar cells 326, 328. Divider lead D8 has three straight segments and two bends D81, D82.

In plan view, bend D81 of divider lead D8 is superimposed with the subdial 62, and bend D82 and the connector 337 end of the divider lead D8 are superimposed with the extended portion 511B.

A through-hole 327A to which the pivot 251 is inserted is formed in the solar cell 327.

Solar cell 328 is separated by divider lead D8 and divider lead D1 from the adjacent solar cells 327, 321.

Configuration of the Connectors 331 to 337 and Electrode Lead 338

The connectors 331 to 337 and electrode lead 338 comprise wiring and insulation layers. As described above, the connectors 331 to 337 connect adjacent solar cells in series, and the electrode lead 338 electrically connects solar cells 326, 327 and the positive and negative electrodes 341, 342 of the solar panel 300.

Figure 5:
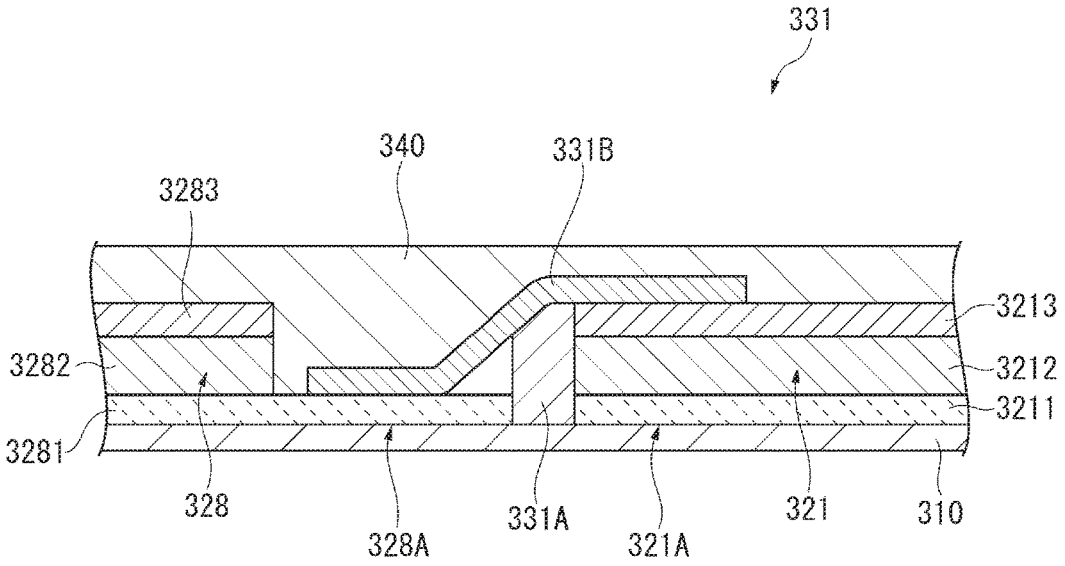
FIG. 5 is a section view of the connector part of the solar panel in this embodiment.

As shown in FIG. 5, connector 331 has an extension 328A extending from solar cell 328, an extension 321A extending from solar cell 321, an insulation layer 331A and a wiring layer 331B.

The extension 328A is configured by the bottom electrode layer 3281. More specifically, the semiconductor layer 3282 and the top electrode layer 3283 are removed from the extension 328A by etching. Extension 321A is configured by a bottom electrode layer 3211, semiconductor layer 3212 and top electrode layer 3213.

The extension 328A and extension 321A are separated by an insulation layer 331A.

The wiring layer 331B is formed from the surface of the bottom electrode layer 3281 of extension 328A to the surface of the top electrode layer 3213 of extension 321A.

The face side of the connector 331 is coated with a sealant layer 340 that covers the surface of the power generating unit 320.

Thus comprised, the connector 331 is connected to the bottom electrode layer 3281 of the solar cell 328, and the top electrode layer 3213 of the solar cell 321.

Note that while the extension 321A comprises a bottom electrode layer 3211, semiconductor layer 3212 and top electrode layer 3213, it does not have an opaque wiring layer 331B on the surface and does not function to generate power. More specifically, the connector 331 is a non-generating part that does not generate power.

The other connectors 332-337 are configuration in the same way as the above connector 331, and connect the bottom electrode layer and top electrode layer of adjacent solar cells.

More specifically, connector 332 connects the bottom electrode layer of solar cell 321, and the top electrode layer of solar cell 322.

Connector 333 connects the bottom electrode layer of solar cell 322, and the top electrode layer of solar cell 323.

Connector 334 connects the bottom electrode layer of solar cell 323 and the top electrode layer of solar cell 324.

Connector 335 connects the bottom electrode layer of solar cell 324 and the top electrode layer of solar cell 325.

Connector 336 connects the bottom electrode layer of solar cell 325 and the top electrode layer of solar cell 326.

Connector 337 connects the bottom electrode layer of solar cell 327 and the top electrode layer of solar cell 328.

Electrode lead 338 connects the bottom electrode layer of solar cell 326 and electrode 342 through a via not shown in the substrate 310. The electrode lead 338 connects to the top electrode layer of the solar cell 327 and electrode 341 through a via not shown in the substrate 310.

As described above, the solar cells 321 to 328 are connected in series between the positive and negative electrodes 341, 342 of the solar panel 300 by the connectors 331-337 and the electrode lead 338. The output voltage of the solar panel 300 is therefore the sum of the output voltages V1 to V8 of the eight solar cells 321 to 328.

In this embodiment the connectors 331-337 and electrode lead 338 are superimposed with the extended portions 501B-512B.

More specifically, part of connector 331 is superimposed with the base portion 512A end of the extended portion 512B.

Part of connector 332 is superimposed with the base portion 501A end of the extended portion 501B.

Part of connector 333 is superimposed with the base portion 503A end of the extended portion 503B.

Part of connector 334 is superimposed with the base portion 505A end of the extended portion 505B.

Part of connector 335 is superimposed with extended portion 506B.

Part of connector 336 is superimposed with the base portion 508A end of the extended portion 508B.

Part of connector 337 is superimposed with the base portion 511A end of the extended portion 511B.

Part of the electrode lead 338 is superimposed with the base portion 509A end of the extended portion 509B.

Because the solar cells 321 to 328 are connected in series, the current of the solar panel 300 is limited to the current of the solar cell 321 to 328 with the smallest current. Therefore, to maximize the power output of the solar panel 300, the current of the solar cells 321 to 328 is preferably as uniform as possible. More specifically, the generating area, which is the area not including the shielded areas that is effective for producing power, is preferably equal in each of the solar cells 321 to 328.

The shape and the area of each of the solar cells 321 to 328 is therefore set so that the generating area not including the extended portions 501B-512B and the subdials 61 to 64 is the same in each of the solar cells 321 to 328 in plan view.

That the generating area of the solar cells 321 to 328 is the same includes being substantially the same, and means that the generating area of the solar cells 321 to 328 is within +/−10% of the average generating area of all solar cells 321 to 328.

Note, further, that the area of the solar cells 321 to 328 means the area minus any openings formed therein, such as the through-holes 320I, 322A, 323A, 324A, 327A, and aperture 320J.

In other words, when, as in this embodiment, a subdial is disposed to the face side of the dial 11 or there are openings (holes) in the solar cell, the generating area of each solar cell will not be the same if divider leads are formed in a radiating pattern at an equal angular interval. If there are no subdials or openings, the generating area of each solar cell can be made substantially equal by forming the divider leads in a radiating pattern at an equal angular interval, but if the number of solar cells is not, as in this example, a divisor of 12 (such as when the number is 5, 7, 8, 9, or 10), all of the connectors and extended portions will not overlap.

Because the divider leads in this embodiment are not simply straight but have bends and curved portions, the divider leads can be drawn freely, the generating area of each solar cell 321 to 328 can be equalized, and the connectors 331-337 and the electrode lead 338 and extended portions 501B-512B can be made to overlap.

Effect of the Embodiment

Because the inside circumference edge of the dial ring 35 is located outside the connectors 331 to 337 of the solar panel 300 in plan view, the inside edge can be located on the outside more easily than if the dial ring 35 overlaps the connectors 331 to 337. As a result, the area inside the dial ring 35 can be increased, the area of the power generating unit 320 of the solar panel 300 can be increased accordingly, and power generation can be improved. More specifically, because the areas between adjacent connectors at the outside perimeter of the solar panel body 300A can be used in the power generating unit 320, the area of the power generating unit 320 can be increased accordingly. As a result, devices with high current consumption, such as a GPS receiver 150, can be incorporated.

Furthermore, because the areas of the solar cells 321 to 328 that overlap the extended portions 501B-512B are not exposed to light, they are non-generating portions that do not produce power. Furthermore, the connectors 331 to 337 and electrode lead 338 have a wiring layer and are non-generating areas. Because at least part of the connectors 331-337 and electrode lead 338 are superimposed with the extended portions 501B-512B in this timepiece 1, the total area of the non-generating parts can be made smaller than if the connectors 331-337 and electrode lead 338 are not superimposed with the extended portions 501B-512B. In other words, the effective generating area, which is the area that is useful for generating power, can be increased and power generation can be improved.

Because the effective generating area can thus be increased, the light transmittance of the dial 11 can be lower while the power output of the solar panel 300 remains the same. In this event, the portions of the connectors 331-337 and electrode lead 338 not superimposed with the extended portions 501B-512B can be obscured and the appearance can be improved.

Furthermore, because the generating area is the same in each of the solar cells 321 to 328, the power output of the solar panel 300 can be maximized.

Furthermore, because the divider leads have bends and curved portions, the divider leads can be drawn more freely than if all divider leads are single straight lines, and the shapes and areas of the solar cells 321 to 328 can be determined freely.

Furthermore, bends in the divider leads are more conspicuous to the user than straight lines, but because the bends in this timepiece 1 are superimposed with the subdials 61 to 64 and the extended portions 501B-512B, they are not visible to the user. The appearance can therefore be improved.

Because the extended portions 501B-512B are disposed to twelve locations along the outside edge of the dial 11 when seen from the face of the timepiece, if the number of connectors 331-337 is 12 or less as in this embodiment, all connectors 331-337 can overlap an extended portion 501B-512B. As a result, the area of overlap between connectors and light shielding members is greater than in a configuration in which superimposing all connectors with a light shielding member is difficult, such as a configuration in which the connectors are superimposed with light shielding members such as curved indicators disposed to selected areas along the outside of the dial. The effective generating area is therefore greater and power generation can be improved.

Other Embodiments

The invention is not limited to the embodiments described above, and can be modified and improved in many ways without departing from the scope of the accompanying claims.

The apparent diameter of the dial 11 is determined by the dial ring 35 in the foregoing embodiment, but the invention is not so limited. For example, the apparent diameter may be determined by extending a portion of the external case 30 to the surface of the dial 11 so that the external case 30 overlaps the outside edge of the dial 11 in plan view. In this configuration, the external case 30 embodies a molding member.

The light shields in the foregoing embodiment are the extended portions 501B-512B and subdials 61 to 64, but the invention is not so limited. More specifically, the light shields may be any member that is opaque and unlike the hands is a member that constantly overlaps a specific area of the solar panel 300. Examples of such members include opaque indicators formed in arcs along the inside circumference edge of the dial ring 35, and disc hands having a hand printed on an opaque disc.

Parts of the connectors 331-337 and electrode lead 338 are superimposed with the extended portions 501B-512B, but the invention is not so limited. For example, by increasing the width of the extended portions 501B-512B in the direction along the inside circumference of the dial ring 35, the connectors 331-337 and electrode lead 338 can be completely covered by the extended portions 501B-512B.

Furthermore, all of the connectors 331-337 and electrode lead 338 are superimposed with the extended portions 501B-512B in the foregoing example, but the invention is not so limited. For example, the electrode lead 338 does not need to be superimposed with an extended portion 501B-512B, and only one of the connectors 331-337 may be superimposed with an extended portion 501B-512B.

Furthermore, the connectors 331 to 337 are disposed along the inside circumference of the dial ring 35 in plan view in the foregoing embodiment, but the invention is not so limited. More specifically, the connectors 331 to 337 may be anywhere inside the dial ring 35.

Furthermore, the connectors 331 to 337 are superimposed with the extended portions 501B-512B in the foregoing example, but the invention is not so limited. More specifically, the connectors 331 to 337 may be superimposed with the subdials 61 to 64, an indicator, disc hand, or other opaque member.

The indexes 501 to 512 are disposed to the dial ring 35 in the foregoing example, but the invention is not so limited. For example, the indexes 501 to 512 may be disposed to the dial 11.

The subdials 61 to 64 are configured separately from the dial 11 in the foregoing example, but the invention is not so limited. More specifically, the subdials 61 to 64 may be disposed in unison with the dial 11. In this event, the subdials 61 to 64 are made from the same material as the dial 11, but opacity can be imparted by increasing the thickness of the subdials.

The subdials 61 to 64 may also be formed by printing or a coating on the dial 11, for example.

The embodiment described above has eight solar cells, but the invention is not so limited. More specifically, the number of solar cells may be other than eight. Preferably, however, there are five or more solar cells.

The EMF of one solar cell is approximately 0.6-0.7 V. As a result, if five solar cells are connected in series, creating a five cell solar panel, the EMF is approximately 0.6-0.7 V×5 cells=approximately 3-3.5 V, which is sufficient to completely charge a 2.4 V lithium ion battery, for example.

Likewise, if seven solar cells are connected in series, the EMF is approximately 0.6-0.7 V×7 cells=approximately 4.2-4.9 V, and if eight solar cells are connected, the EMF is approximately 0.6-0.7 V×8 cells=approximately 4.8-5.6 V, and a 3.7 V lithium ion battery can be completely charged.

Because a lithium ion battery with a high EMF of 2.4 V or 3.7 V can then be used as the power supply, a device such as a GPS receiver with high current consumption can be incorporated and driven.

The generating area is the same in each of the solar cells 321 to 328 in the embodiment described above, but the invention is not so limited. More specifically, the generating areas may differ.

Furthermore, the solar cells 321 to 328 in the foregoing embodiment are amorphous silicon solar cells, but the invention is not so limited. The solar cells 321 to 328 may be a different type of solar cell.

The divider leads in the foregoing embodiment have bends, but the invention is not so limited. For example, the divider leads may comprise only curved portions and straight portions with no bends (corners).

The embodiment is described with reference to a timepiece having an antenna 110 and GPS receiver 150 above, but the invention can obviously be used in timepieces that do not have an antenna and receiver.

The connectors 331 to 337 in the foregoing embodiment are connected by a wiring layer connecting the bottom electrode layer extending from one of two adjacent solar cells to the top electrode layer extending from the other solar cell, but the invention is not so limited. For example, the bottom electrode layer and the top electrode layer may be connected by laser bonding or other connection method.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2015-144949, filed Jul. 22, 2015 is expressly incorporated by reference herein.

What is claimed is:

1. A timepiece comprising:

a solar panel including a plurality of solar cells, the solar cells being divided by divider leads extending radially from a central region of the solar panel toward an outside perimeter of the solar panel;

a dial plate disposed on a face side of the solar panel and configured to transmit a light;

a molding member disposed to the face side of the dial plate overlapping an outside edge of the dial plate when seen from a face side of the timepiece; and an opaque light shield disposed on the face side of the dial plate on an inside side of the molding member;

the solar panel having connectors that connect adjacent solar cells in series, the connectors are disposed on the outside perimeter of the solar panel and are covered by the light shield when seen from the face side of the timepiece, and an area of the outside perimeter of the solar panel between adjacent connectors is configured to generate power.

2. The timepiece described in claim 1, wherein:

the generating area that receives light through the dial plate is the same in each of the solar cells.

3. The timepiece described in claim 1, wherein:

at least one of the divider leads separating one solar cell from the adjacent solar cell has a bend, and the bend is covered by the light shield when seen from the face.

4. The electronic timepiece described in claim 1, wherein:

the solar panel includes five or more solar cells.

5. The electronic timepiece described in claim 1, further comprising:

an hour hand;

the light shield being a marker representing the hour when pointed to by the hour hand.

6. The electronic timepiece described in claim 1, further comprising:

twelve markers disposed at equal intervals along the inside circumference of the molding member as light shields;

a first subdial disposed near 2:00, a second subdial disposed near 10:00, and a third subdial disposed near 6:00 around the plane center of the dial plate when seen from the face; and an aperture formed in the solar panel at a position corresponding to 4:00 on the dial plate;

the solar panel including eight solar cells;

the connectors being disposed at positions corresponding to 12:00, 1:00, 3:00, 5:00, 6:00, 8:00, and 11:00 on the dial plate; and at least part of each connector being covered by a marker when seen from the face.

7. The electronic timepiece described in claim 1, wherein each solar cell includes a lower electrode layer, a semiconductor layer, an upper electrode layer, and a sealing resin layer; and a first connector connecting a first of the plurality of solar cells to an adjacent second of the plurality of solar cells is connected to the lower electrode layer of the first of the plurality of solar cells and the upper electrode layer of the second of the plurality of solar cells.

8. The electronic timepiece described in claim 1, wherein a plurality of areas of the outside perimeter of the solar panel between adjacent connectors are configured to generate power.

9. The electronic timepiece described in claim 1, wherein the molding member is a dial ring and is disposed between the dial plate and a crystal.

* * * * *